US011071996B2

(12) United States Patent
Ikushima

(10) Patent No.: US 11,071,996 B2
(45) Date of Patent: Jul. 27, 2021

(54) LIQUID MATERIAL DISCHARGE DEVICE, COATING DEVICE THEREOF, AND COATING METHOD

(71) Applicant: MUSASHI ENGINEERING, INC., Tokyo (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 1168 days.

(21) Appl. No.: 14/775,161

(22) PCT Filed: Mar. 13, 2014

(86) PCT No.: PCT/JP2014/056672
§ 371 (c)(1),
(2) Date: Sep. 11, 2015

(87) PCT Pub. No.: WO2014/142239
PCT Pub. Date: Sep. 18, 2014

(65) Prior Publication Data

US 2016/0023232 A1 Jan. 28, 2016

(30) Foreign Application Priority Data

Mar. 14, 2013 (JP) ..... JP2013-052567

(51) Int. Cl.
*B05C 5/02* (2006.01)
*B05C 11/10* (2006.01)

(52) U.S. Cl.
CPC ..... *B05C 5/0225* (2013.01); *B05C 11/1034* (2013.01); *B05C 11/1047* (2013.01)

(58) Field of Classification Search
None
See application file for complete search history.

(56) References Cited

U.S. PATENT DOCUMENTS 2,650,003 A * 8/1953 Coleman ..... A01G 25/00 118/410
4,808,303 A * 2/1989 Edwards ..... A47F 3/0495 210/138

(Continued)

FOREIGN PATENT DOCUMENTS

JP 62-269771 A 11/1987
JP 9-108605 A 4/1997

(Continued)

OTHER PUBLICATIONS

International Search Report dated Jun. 3, 2014, issued in counterpart Application No. PCT/JP2014/056672 (2 pages).

(Continued)

*Primary Examiner* — Michael P. Rodriguez
(74) *Attorney, Agent, or Firm* — Westerman, Hattori, Daniels & Adrian, LLP

(57) ABSTRACT

A liquid material discharge device (20) has a nozzle member (35) provided with a discharge opening (33) through which a liquid material is discharged, a switching valve (51) in communication with the nozzle member, and a discharge controller. The discharge device further includes a pressurization section (60) having a pressurization passage (62) through which the liquid material under pressurization is supplied to the switching valve, and a negative pressure section (70) including a shunt passage (72) where a pressure can be set to be relatively lower than that in the pressurization passage. The switching valve is changed over between a first position at which the discharge opening communicates with the pressurization passage and the discharge opening is cut off from the shunt passage, and a second position where the discharge opening is communicated with the shunt passage and the discharge opening is cut off from the pressurization passage.

19 Claims, 9 Drawing Sheets

(56) References Cited

U.S. PATENT DOCUMENTS

| | | | | |
|---|---|---|---|---|
| 5,046,666 | A * | 9/1991 | Ono | B05C 5/02 239/119 |
| 5,989,622 | A * | 11/1999 | Iwashita | B05C 5/0254 427/256 |
| 7,134,617 | B2 | 11/2006 | Ikushima | |
| 2007/0227227 | A1* | 10/2007 | Ikushima | B05C 11/1002 73/1.74 |
| 2010/0009070 | A1 | 1/2010 | Shoji et al. | |
| 2010/0229826 | A1 | 9/2010 | Engineer | |
| 2013/0155133 | A1 | 6/2013 | Ikeda | |

FOREIGN PATENT DOCUMENTS

| | | | |
|---|---|---|---|
| JP | 2002-326715 | A | 11/2002 |
| JP | 2007-196109 | A | 8/2007 |
| JP | 2008-124447 | A | 5/2008 |
| JP | 2009-82859 | A | 4/2009 |
| JP | 4663894 | B2 | 4/2011 |
| WO | 2012/111313 | A1 | 8/2012 |

OTHER PUBLICATIONS

Office Action dated Jun. 18, 2020, issued in counterpart KR Application No. 10-2015-7024043, with English Translation. (12 pages).

* cited by examiner

Fig. 2 -- Prior Art--

LIQUID MATERIAL DISCHARGE DEVICE, COATING DEVICE THEREOF, AND COATING METHOD

TECHNICAL FIELD

The present invention relates to a liquid material discharge device that discharges liquid materials, ranging from a low-viscosity liquid material to a high-viscosity liquid material such as a solder paste, a silver paste, or an adhesive, in a constant amount regardless of whether the liquid material contains a filler. The present invention further relates to an application device using the liquid material discharge device, and an application method using the application device.

BACKGROUND ART

A screw-type discharge device is known in which a spiral flange formed on a surface of a rod-shaped member to extend in a lengthwise direction of the rod-shaped member is rotated, and a liquid is carried by the flange with the rotation of the screw, whereby the liquid is discharged. The applicant also proposes, in Patent Document 1, a screw-type discharge device for discharging a liquid in a constant amount, the discharge device being particularly designed to accurately discharge a liquid containing a filler.

FIG. 14 illustrates a screw-type discharge device 10, disclosed in Patent Document 1, which includes a screw 7 having a spiral blade that is provided on a surface of a rod 8, and that extends from a tip of the rod in a lengthwise direction, a motor 9 (rotation driving mechanism) for rotating the screw 7, a main body 1 provided with a liquid inlet 4 through which a liquid material is supplied, a screw through-hole 2 through which the screw 7 penetrates, and a housing 5 that covers the tip of the screw 7 at the side close to a discharge opening, and a nozzle 6 fitted to an end of the housing 5 and communicating with the interior of the housing 5, wherein the liquid is discharged with rotation of the screw 7. In a preferred embodiment of the discharge device 10, it is proposed to set a gap between the screw 7 and an inner wall surface of the housing 5 to be larger than the particle diameter of the filler or the particle diameter of a filler cluster.

As another type of discharge device, there is known a jet-type discharge device in which an inertial force is given to a liquid material by a plunger that is quickly advanced, and the liquid material is discharged in a way of flying from a discharge opening in the form of divided droplets.

As a discharge device of the type striking the plunger against a valve seat to discharge the droplets, there is known a droplet constant discharge device, proposed in Patent Document 2 patented to the applicant, in which when a switching valve takes a first position, a plunger rod is retracted with valve-operating air to open a discharge opening, and when the switching valve takes a second position, the plunger rod is advanced by a plunger-rod advancing mean to strike against the valve seat, whereupon the plunger rod is abruptly stopped and the liquid is discharged from the discharge opening of the valve in a way of flying in the form of droplets.

CITATION LIST

Patent Documents

Patent Document 1: Japanese Patent Laid-Open Publication No. 2002-326715

Patent Document 2: Japanese Patent No. 4663894

SUMMARY OF INVENTION

Technical Problem

In such a discharge device as represented by (a) the discharge device in which the liquid material is discharged with rotation of the screw including the spiral blade that is provided on the rod surface, and that extends from the rod tip in the lengthwise direction, or by (b) the discharge device in which the liquid material is discharged with rotation or forward movement of the rod, and as being featured in that the discharge opening and a liquid material supply source are kept communicated with each other even in a discharge operation stand-by state, there is an problem of liquid dripping, i.e., a leakage of the liquid material through the discharge opening in the discharge operation stand-by state. In the discharge device 10 illustrated in FIG. 14, for example, because the gap is present between the screw and the inner wall surface of the housing, the liquid material may leak from the discharge opening through the gap in the discharge operation stand-by state. That problem is more serious when a liquid material having relatively low viscosity is discharged.

To solve the above-mentioned problem, Patent Document 1 proposes techniques of applying a pulse-like pressure to the liquid material during discharge, and applying a negative pressure to the liquid material in a reservoir in the discharge stand-by state, to thereby prevent the liquid material from dripping from the nozzle tip.

However, the above-mentioned technique of applying the pulse-like pressure to the liquid material (i.e., a method of delivering air to a space within the reservoir to apply a pressure to the liquid material per discharge) has a problem that, because of air being compressive, a time is taken to release the residual pressure in a liquid chamber communicating with the discharge opening. Such a problem causes reduction of productivity. It is hence demanded to shorten the time taken to release the residual pressure in the liquid chamber.

An object of the present invention is to provide a discharge device capable of effectively solving the problem of the liquid dripping and increasing the operability of a discharge operation, and to provide the application device using the discharge device, and the application method using the application device.

Solution to Problem

The present invention related to a liquid material discharge device resides in a liquid material discharge device comprising a discharge opening through which a liquid material is discharged, a liquid chamber in communication with the discharge opening, the liquid material being supplied to the liquid chamber, a propulsion force applying member disposed in the liquid chamber and applying, to the liquid material, a propulsion force necessary to discharge the liquid material, a driving source for the propulsion force applying member, the driving source operating the propulsion force applying member, and a discharge controller, wherein the discharge device further comprises a pressurization section including a pressurization passage through which the liquid material under pressurization is supplied to the liquid chamber, a negative pressure section including a shunt passage in which a pressure can be set to be relatively lower than a pressure in the liquid chamber, and a liquid valve section having a liquid material supply opening through which the liquid chamber and the pressurization passage are communicated with each other, and a liquid material release opening through which the liquid chamber and the shunt passage are communicated with each other, the liquid valve section including a switching valve that is changed over between a first position at which communication between the liquid chamber and the liquid material supply opening is established and communication between the liquid chamber and the liquid material release opening is cut off, and a second position at which the communication between the liquid chamber and the liquid material release opening is established and the communication between the liquid chamber and the liquid material supply opening is cut off.

In the present invention related to the above liquid material discharge device, the pressurization section may include a liquid reservoir and a pressurization source that supplies pressurized air to the liquid reservoir, and the negative pressure section may include a negative pressure source that is directly or indirectly communicated with the shunt passage. Preferably, the negative pressure section includes a shunt container for the liquid material, the shunt container having a larger diameter than the shunt passage. More preferably, the negative pressure section includes a drain passage through which the liquid material stored in the shunt container is drained. Even more preferably, the negative pressure section includes a drain passage opening/closing mechanism that establishes or cuts off communication between the drain passage and the outside. In the present invention including the drain passage opening/closing mechanism, the negative pressure section may include a pressurization source that supplies pressurized air to the shunt container, and a negative pressure section switching valve having a pressurization position at which the pressurization source is communicated with the shunt container, and a depressurization position at which the negative pressure source is communicated with the shunt container. Preferably, the drain passage opening/closing mechanism is an on/off valve, the pressurization section includes a pressurization-section on/off valve that establishes or cuts off communication between the pressurization section and the liquid valve section, and the discharge controller closes the pressurization-section on/off valve, changes over the negative pressure section switching valve to the pressurization position, and opens the drain passage opening/closing mechanism in accordance with predetermined drain conditions, thereby draining the liquid material in the shunt container to the outside. Here, the drain conditions include the case where the liquid material is drained per certain time, and the case where the liquid material is drained per certain number of discharges.

In the present invention including the shunt container, the negative pressure section may include a slender negative pressure adjusting pipe disposed in the shunt container, the negative pressure adjusting pipe having one opening in communication with the shunt passage and the other opening disposed in a space within the shunt container.

In the present invention including the pressurization source and the negative pressure source, the discharge controller may perform control such that, in a discharge stand-by state, a negative pressure force necessary to prevent liquid dripping through the discharge opening is applied to the shunt passage from the negative pressure source, and that, at end of the discharge, a negative pressure force stronger than the negative pressure force applied in the discharge stand-by state is applied to the shunt passage from the negative pressure source.

In the present invention including the pressurization source and the negative pressure source, the discharge controller may perform control such that, during discharge operation, a pressurization force necessary to discharge the liquid material through the discharge opening is applied to the liquid reservoir from the pressurization source, and that, in a discharge stand-by state, a pressurization force stronger than the pressurization force during the discharge operation is applied to the liquid reservoir from the pressurization source.

In the present invention related to the above liquid material discharge device, the propulsion force applying member may be a rotating screw or a rod-shaped member that gives an inertial force to the liquid material with quick forward movement, the screw and the rod-shaped member each having a smaller diameter than the liquid chamber. As an alternative, the propulsion force applying member may be a rod having a male spiral shape and rotating eccentrically, the liquid chamber may have an inner wall surface having a female spiral shape and cooperating with the propulsion force applying member, and the propulsion force applying member and the liquid chamber may constitute a uniaxial eccentric screw pump mechanism.

The present invention related to a liquid material discharge device resides in a liquid material discharge device comprising a nozzle member provided with a discharge opening through which a liquid material is discharged, a switching valve in communication with the nozzle member, and a discharge controller, wherein the discharge device further comprises a pressurization section including a pressurization passage through which the liquid material under pressurization is supplied to the switching valve, and a negative pressure section including a shunt passage in which a pressure can be set to be relatively lower than a pressure in the pressurization passage, the switching valve constituting a liquid valve section that has a liquid delivery opening in communication with the discharge opening, a liquid material supply opening in communication with the pressurization passage, and a liquid material release opening in communication with the shunt passage, the switching valve being changed over between a first position at which the discharge opening is communicated with the pressurization passage and the discharge opening is cut off from the shunt passage, and a second position at which the discharge opening is communicated with the shunt passage and the discharge opening is cut off from the pressurization passage. Preferably, the liquid valve section and the nozzle member are communicated with each other through a flexible tube.

The present invention related to an application device resides in an application device comprising the liquid material discharge device described above, a work table on which an application object is placed, an XYZ driving mechanism that relatively moves the liquid material discharge device and the work table, and a driving mechanism controller that controls operation of the XYZ driving mechanism.

The present invention related to an application method resides in a liquid material application method using an application device that comprises the liquid material discharge device described above, a work table on which an application object is placed, an XYZ driving mechanism that relatively moves the liquid material discharge device and the work table, and a driving mechanism controller that controls operation of the XYZ driving mechanism, wherein the discharge controller executes steps of, during discharge operation, discharging the liquid material through the discharge opening by operating the propulsion force applying member in a state that the switching valve in the liquid valve section is held at the first position, and at end of the discharge, stopping the discharge of the liquid material through the discharge opening by stopping the operation of the propulsion force applying member and changing over the switching valve in the liquid valve section to the second position.

The present invention related to an application method resides in a liquid material application method using an application device that comprises the liquid material discharge device including the pressurization source and the negative pressure source, a work table on which an application object is placed, an XYZ driving mechanism that relatively moves the liquid material discharge device and the work table, and a driving mechanism controller that controls operation of the XYZ driving mechanism, wherein the discharge controller executes steps of, during discharge operation, discharging the liquid material through the discharge opening by operating the propulsion force applying member in a state that the switching valve in the liquid valve section is held at the first position, and at end of the discharge, stopping the discharge of the liquid material through the discharge opening by stopping the operation of the propulsion force applying member and changing over the switching valve in the liquid valve section to the second position, the discharge controller further executing steps of, in a discharge stand-by state, applying a negative pressure force, which is necessary to prevent liquid dripping through the discharge opening, to the shunt passage from the negative pressure source, and at the end of the discharge, applying a negative pressure force, which is stronger than the negative pressure in the discharge stand-by state, to the shunt passage from the negative pressure source. Preferably, the discharge controller executes steps of, during the discharge operation, applying a pressurization force, which is necessary to discharge the liquid material through the discharge opening, to the liquid reservoir from the pressurization source, and in the discharge stand-by state, applying a pressurization force, which is stronger than the pressurization force during the discharge operation, to the liquid reservoir from the pressurization source.

The present invention related to an application method resides in a liquid material application method using an application device that comprises the liquid material discharge device including the drain passage opening/closing mechanism, the negative pressure section switching valve, and the pressurization-section on/off valve, a work table on which an application object is placed, an XYZ driving mechanism that relatively moves the liquid material discharge device and the work table, and a driving mechanism controller that controls operation of the XYZ driving mechanism, wherein the discharge controller executes steps of, during discharge operation, discharging the liquid material through the discharge opening by operating the propulsion force applying member in a state that the switching valve in the liquid valve section is held at the first position, and at end of the discharge, stopping the discharge of the liquid material through the discharge opening by stopping the operation of the propulsion force applying member and changing over the switching valve in the liquid valve section to the second position, the discharge controller further executing a step of draining the liquid material in the shunt container to the outside by closing the pressurization section on/off valve, changing over the negative pressure section switching valve to the pressurization position, and opening the on/off valve of the drain passage opening/closing mechanism in accordance with predetermined drain conditions. Here, the drain conditions include the case where the liquid material is drained per certain time, and the case where the liquid material is drained per certain number of discharges.

Advantageous Effect of Invention

With the present invention, the discharge device can be provided which is able to effectively solve the problem of the liquid dripping and to increase the operability of a discharge operation. The application device using the discharge device, and the application method using the application device can be further provided.

DESCRIPTION OF EMBODIMENTS

Exemplary embodiments for carrying out the present invention will be described below in connection with the drawings. In the following description, the side where a reservoir 12 is present is called an upward direction, and the side where a nozzle 33 is present is called a downward direction in some cases for the sake of convenience in explanation.

Configuration of First Embodiment

Figure 1:
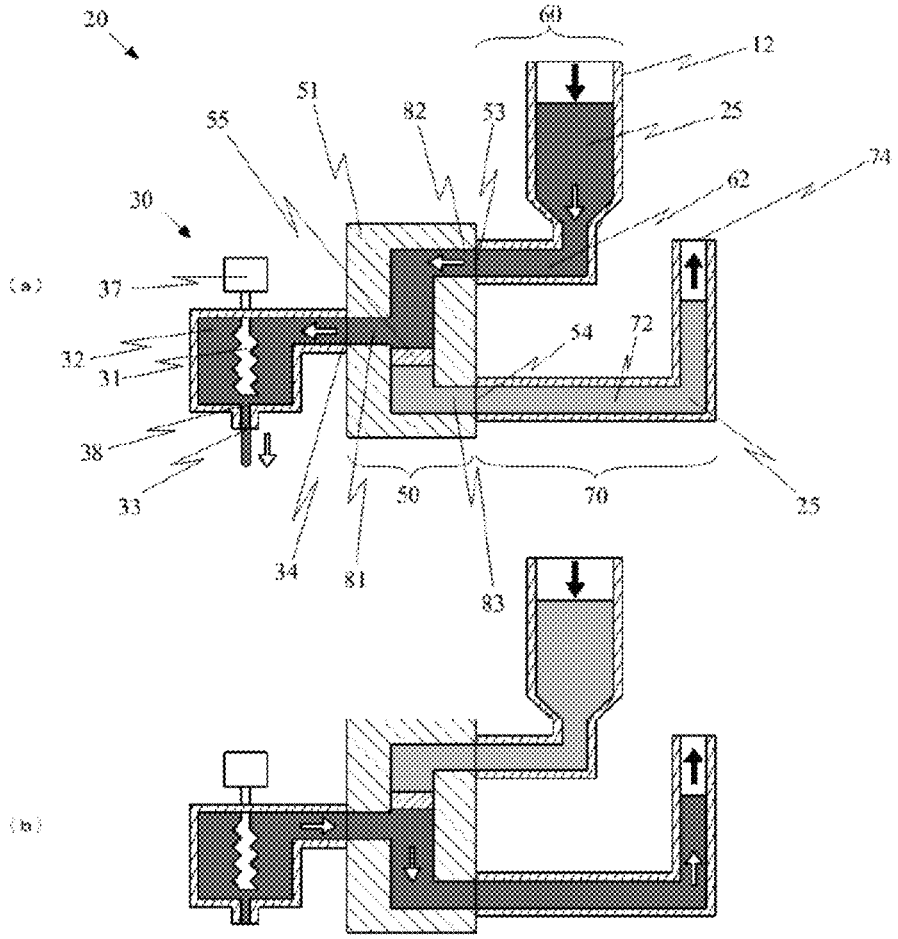
FIG. 1 is a schematic sectional view of principal part to explain pressure conditions in passages of a discharge device according to a first embodiment; specifically, FIG. 1(*a*) illustrates a discharge turn-on state, and FIG. 1(*b*) illustrates a discharge stand-by state.

FIG. 1 is a schematic sectional view of principal part to explain pressure conditions in passages of a discharge device 20 according to a first embodiment; specifically, FIG. 1(*a*) illustrates a discharge turn-on state, and FIG. 1(*b*) illustrates a discharge stand-by state. As illustrated in FIG. 1, the liquid material discharge device 20 according to the first embodiment includes, as main components, a discharge unit 30, a liquid valve section 50, a pressurization section 60, and a negative pressure section 70. It is to be noted that, in FIG. 1, a liquid material 25 under the same pressure as that in a liquid chamber 32 is illustrated darker, and the liquid material 25 under a pressure different from that in the liquid chamber 32 is illustrated lighter.

The discharge unit 30 includes a rod 31 that is a member for applying a propulsion force, the liquid chamber 32 into which the rod is inserted, a discharge opening 33 that is formed at a lower end of a nozzle in communication with the liquid chamber 32, a liquid material supply opening 34 in communication with a lateral surface of the liquid chamber 32, and a rod driving source 37 for rotating the rod 31. While, in the first embodiment, a rod-shaped member is used, by way of example, as the propulsion force applying member, the shape of the propulsion force applying member is not limited to such an example. Various types of members capable of giving dynamic actions based on reciprocating movement, translational movement, vibration, etc. to an opening 38, which is formed in a bottom surface of the liquid chamber, can be used optionally. The present invention is particularly suitable for a discharge device of the type that the opening 38 in the bottom surface of the liquid chamber is not closed by the propulsion force applying member in the discharge stand-by state. That type of discharge device includes a jet-type discharge device in which the propulsion force applying member is caused to strike against the bottom surface of the liquid chamber, thereby dividing the liquid material into droplets.

The liquid valve section 50 includes a switching valve 51. The switching valve 51 in the first embodiment includes a passage A 81 directly connected to the discharge unit 30, a passage B 82 functioning as a pressurization passage, a passage C 83 functioning as a shunt passage, and a valve member 55 for switching over the communication between the passage A 81 and each of the passage B 82 and the passage C 83. Insofar as the switching valve 51 is a three-way valve capable of switching over the communication between the pressurization section 60 and the liquid chamber 32 and the communication between the negative pressure section 70 and the liquid chamber 32, the type and the structure of the switching valve 51 are not limited to particular ones. The switching valve 51 may be, for example, of the type reciprocating a valve member by an electromagnetic motor or an air motor, or deforming a diaphragm by a solenoid driver. The operation of the switching valve 51 will be described later.

Figure 14:
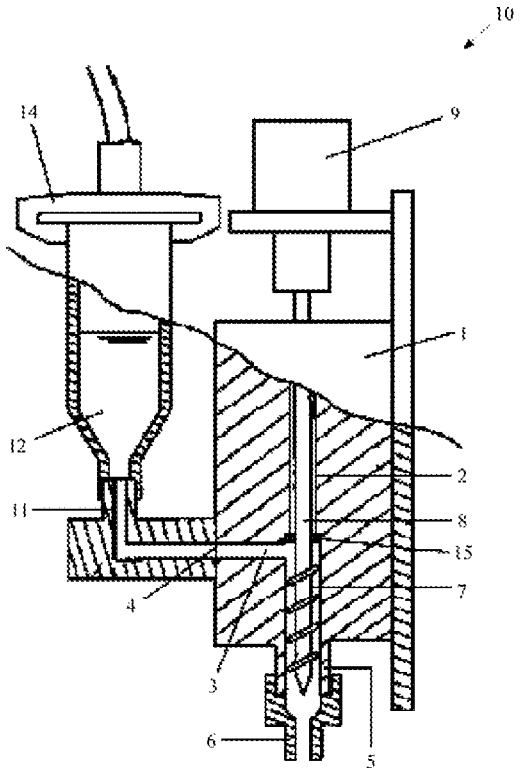
Fig. 14 PRIOR ART
FIG. 14 is a schematic view, partly sectioned, of a prior-art discharge device disclosed in FIG. 2 of Patent Document 1.

While, in FIG. 1, a gap between the liquid chamber 32 and the rod 31 is set to be broad, the gap between the liquid chamber 32 and the rod 31 may be set to be relatively narrow, as illustrated in FIG. 14, such that a stronger liquid propulsion force is generated with the operation of the rod 31.

The pressurization section 60 includes a reservoir 12, a pressurization passage 62 through which the reservoir and the liquid valve section 50 are communicated with each other, and a pressurization device (not illustrated) for applying pressure to the reservoir. The pressurization passage 62 may be constituted by a flexible tube, or may be formed within a member (e.g., a liquid delivery block described later) that is removably attached to the reservoir 12. The reservoir 12 is not limited to one having the illustrated shape, and it may be formed in any suitable shape. In the discharge device 20 of the first embodiment, an upper space within the reservoir 12 is communicated with the not-illustrated pressurization device.

The negative pressure section 70 includes the shunt passage 72 having an end opening 74. The end opening 74 of the shunt passage is opened to the atmosphere, or is communicated with a negative pressure generator (not illustrated). Preferably, the negative pressure generator is disposed such that the liquid material in the shunt passage 72 is held under a desired pressure having been adjusted in advance for preparation, thus causing the desired pressure to quickly act on the liquid material in the liquid chamber 32 immediately after the switching operation of the switching valve 51.

The shunt passage 72 preferably has, in its overall length, an inner diameter much larger than that of the discharge opening 33. More preferably, a shunt container having a larger diameter than the shunt passage 72 is disposed between the end opening 74 of the shunt passage and the negative pressure generator (not illustrated). The shunt container may have any suitable shape insofar as it has a larger diameter than the shunt passage 72. In consideration of an installation space, however, the shunt container has a pipe-like shape in one preferred embodiment (see a shunt pipe 76 described later).

<Configuration and Operation of Prior-Art Device>

Figure 2:
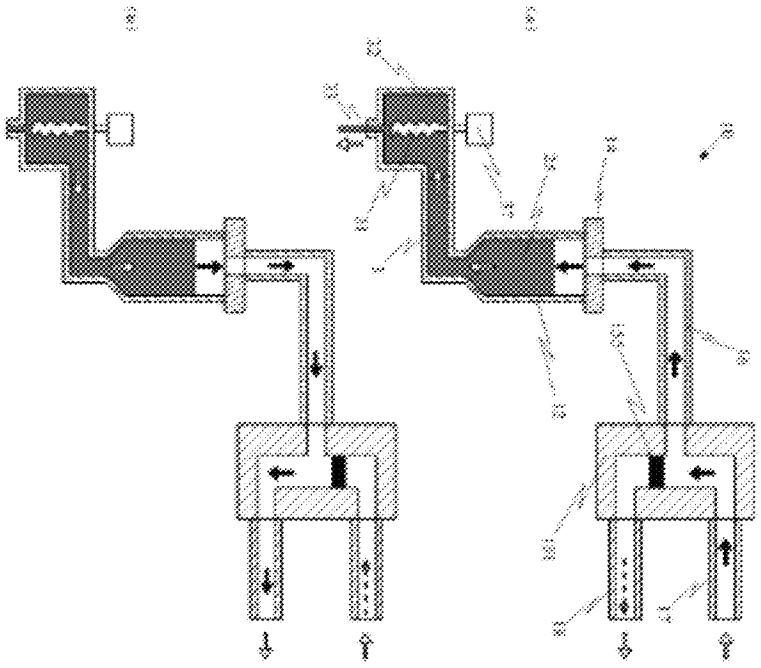
FIG. 2 is a schematic sectional view of principal part to explain pressure conditions in passages of a prior-art discharge device; specifically, FIG. 2(*a*) illustrates a discharge turn-on state, and FIG. 2(*b*) illustrates a discharge stand-by state.

FIG. 2 is a schematic sectional view of principal part to explain pressure conditions in passages of a prior-art discharge device; specifically, FIG. 2(*a*) illustrates a discharge turn-on state, and FIG. 2(*b*) illustrates a discharge stand-by state.

A prior-art discharge device 10, illustrated in FIG. 2, is similar in structure of the discharge unit to that in the first embodiment, but it is different from the first embodiment, illustrated in FIG. 1, in that the discharge unit is communicated with the reservoir 12 without interposition of a switching valve 151 between them. Furthermore, the switching valve 151 in the discharge device, illustrated in FIG. 2, is different in a point of switching over gas passages from the switching valve 51 in the first embodiment, which switches over the liquid passages.

In the discharge device 10, as in the first embodiment, the liquid material in the liquid chamber 32 is discharged through the discharge opening 33 by the action of rotating movement of the rod 31. In this connection, as illustrated in FIG. 14, the gap between the liquid chamber 32 and the rod 31 may be set to be relatively narrow such that a stronger liquid propulsion force is generated with the operation of the rod 31.

During the discharge operation, as illustrated in FIG. 2(*a*), the reservoir 12 is communicated with a tubing line B 17 through an adaptor 14, a tubing line A 16, and the switching valve 151, and the reservoir 12 is subjected to the pressurization action through the tubing line B 17. In other words, a valve member 155 of the switching valve 151 takes a first position at which the tubing line A 16 and the tubing line B 17 are communicated with each other, and pressurized air having been adjusted to the desired pressure at the side upstream of the tubing line B 17 is supplied to an upper space within the reservoir 12 through the tubing line A 16.

After the end of the discharge operation, as illustrated in FIG. 2(*b*), the operation of the rod driving source 37 is stopped to stop the operation of the rod 31, and the valve member 155 of the switching valve 151 is changed over to a second position at which the tubing line A 16 and the tubing line C 18 are communicated with each other. The pressure in the tubing line C 18 is adjusted so as to generate a negative pressure in the reservoir 12. Upon the switching valve 151 being changed over to the second position, therefore, the pressurized air in the tubing line A 16, the adaptor 14, and the reservoir 12 is caused to flow toward the tubing line C18 at a time. Accordingly, the air pressure in the reservoir 12 is reduced, and the pressure acting on the liquid material 25 in the reservoir 12 is also reduced. Hence the liquid material is no longer discharged through the discharge opening 33.

In the discharge stand-by state, because the switching valve 151 holds the second position to keep the tubing line A 16 and the tubing line C18 communicated with each other, the negative pressure is supplied to the reservoir 12, and the liquid material is prevented from dripping through the discharge opening 33.

Thus, in the prior-art discharge device 10, the discharge operation is performed and dripping of the liquid material in the discharge stand-by state is prevented by pressurizing and depressurizing the upper space within the reservoir 12, respectively.

However, the prior-art discharge device 10 has a problem that a response delays because of gas being compressive. The problem of response delay occurs not only when the switching valve 151 takes the first position, but also when the switching valve 151 takes the second position.

On the other hand, in the discharge device 20 of the present invention, since pressure is transmitted to the liquid chamber 32 with the aid of the liquid material 25, the problem of response delay does not occur when the position of the switching valve 51 is changed over. The operation of changing over the position of the switching valve 51 in the first embodiment will be described below with reference to FIG. 1.

<Switching Operation in First Embodiment>

During the discharge operation, as illustrated in FIG. 1(*a*), the switching valve 51 takes the first position at which the pressurization passage 62 and the passage A 81 are communicated with each other, and the liquid material 25 is supplied from the reservoir 12 to the liquid chamber 32. Here, the reservoir 12 is connected to the pressurization device (not illustrated), and the upper space within the reservoir 12 is always pressurized to the desired pressure. During the discharge operation, the communication between the shunt passage 72 and the liquid chamber 32 is cut off.

After the end of the discharge operation, as illustrated in FIG. 1(*b*), the operation of the rod driving source 37 is stopped to stop the operation of the rod 31, and the switching valve 51 is changed over to the second position at which the shunt passage 72 and the passage A 81 are communicated with each other. The pressure in the shunt passage 72 is adjusted so as to generate a negative pressure in the liquid chamber 32. Upon the switching valve 51 being changed over to the second position, therefore, the liquid material in the passage A 81 and the liquid chamber 32 is caused to flow toward the shunt passage 72 at a time. In other words, since the liquid material 25 in the shunt passage 72 is under lower pressure than the liquid material 25 in the passage A 81 and the liquid chamber 32, a force acting to withdraw the liquid material in the passage A 81 and the liquid chamber 32 toward the shunt passage 72 is generated upon the switching valve 51 being changed over from the first position to the second position. Accordingly, the liquid pressure in the liquid chamber 32 is reduced, and the liquid material is no longer discharged through the discharge opening 33.

In a preferred embodiment disclosed here, the negative pressure acting on the liquid chamber 32 is changed between the state immediately after the end of the discharge and the discharge stand-by state. Stated in another way, it is disclosed here that a stronger negative pressure is generated in the shunt passage 72 during the discharge operation to act the stronger negative pressure on the liquid chamber at the end of the discharge, thereby developing the action of strongly withdrawing back the liquid material immediately after the end of the discharge operation, and that, in the discharge stand-by state after the end of the discharge operation, a proper negative pressure lower than that during the discharge operation (i.e., a negative pressure adapted to prevent the liquid dripping) is generated in the shunt passage 72.

Furthermore, in the discharge device 10 of the first embodiment, since the communication between the reservoir 12 and the liquid chamber 32 is cut off in the discharge stand-by state, the pressure of the pressurized air supplied to the reservoir 12 can be set to different levels between the discharge turn-on state and the discharge stand-by state. More specifically, it is disclosed here as a preferred embodiment that, in the discharge stand-by state, the pressure applied to the reservoir 12 is adjusted to a different desired pressure (i.e., a pressure higher than the desired pressure in the discharge turn-on state) with intent to quickly supply an optimum pressure to the liquid chamber 32 immediately after the switching operation of the switching valve 51.

Thus, in the first embodiment, since the pressure in the liquid chamber communicating with the discharge opening is adjusted by utilizing a pressure difference of the liquid material that is not compressive, responsivity in the switching operation of the switching valve is significantly superior to that in the prior-art discharge device utilizing a pressure difference of gas. Higher responsivity in pressurization and depressurization contributes to improving quality and productivity of the discharge operation. In the discharge stand-by state, the liquid dripping through the discharge opening can be prevented.

Configuration of Second Embodiment

Figure 15:
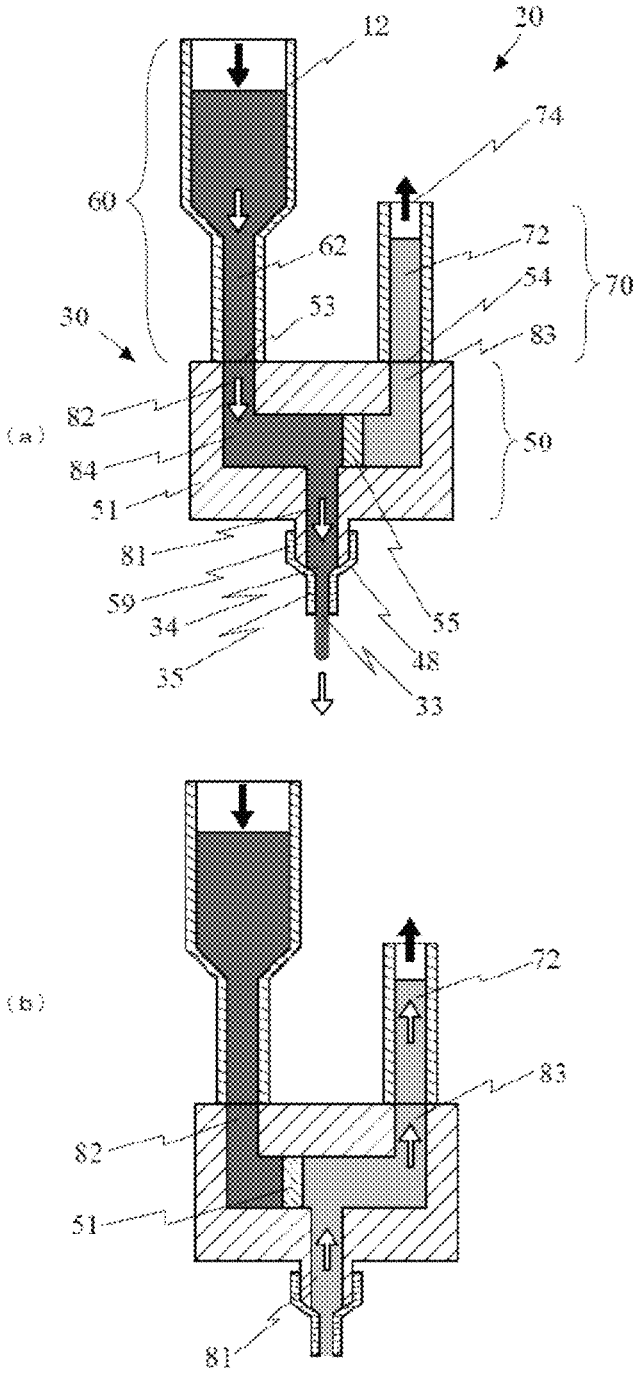
FIG. 15 is a schematic view, partly sectioned, to explain pressure conditions in passages of a discharge device according to a second embodiment; specifically, FIG. 15(*a*) illustrates a discharge turn-on state, and FIG. 15(*b*) illustrates a discharge stand-by state.

FIG. 15 is a schematic side view, partly sectioned, to explain a liquid material discharge device 20 according to a second embodiment. In the following, description of components common to those of the first embodiment (FIG. 1) is omitted, and components different therefrom are primarily described.

A liquid valve section 50 includes a switching valve 51 similar to that in the first embodiment. The switching valve 51 in the second embodiment includes a passage A 81 having an outlet in a joint portion 59, a passage B 82 functioning as a pressurization passage, a passage C 83 functioning as a shunt passage, a valve member 55 disposed in a switching passage 84, and a valve member driver (not illustrated) that reciprocates the valve member 55 across the passage A 81 to switch over the communication between the passage A 81 and each of the passage B 82 and the passage C 83.

In the discharge turn-on state illustrated in FIG. 15(*a*), the valve member 55 is positioned at the right side of the passage A 81, and the liquid material having entered the passage B 82 through a liquid material supply opening 53 flows out to a nozzle 35 through a liquid delivery opening 34.

In the discharge stand-by state illustrated in FIG. 15(*b*), the valve member 55 is positioned at the left side of the passage A 81, and a discharge opening 33 is communicated with an end opening 74 through a shunt passage 72, a liquid material release opening 54, the switching passage 84, the passage A 81, and the liquid delivery opening 34. Thus, the pressure remaining in a passage within the nozzle 35 is released.

The switching valve 51 illustrated in FIG. 15 is different from the switching valve in the first embodiment in that the joint portion 59 is provided at a lower end of the switching valve, and that the passage B 82 and the passage C 83 are opened upward and the passage A 81 is opened downward. The passage A 81, the passage B 82, and the passage C 83 are not limited to ones having certain lengths as illustrated, and they may have very short distances such as being not regarded as passages in some cases. Those cases are also involved within the technical concept of the present invention.

The passage A 81 is not always required to be opened downward in the vertical direction, and it may be opened horizontally or obliquely downward, for example.

A discharge member 48 is removably attached to the joint portion 59 by fixtures using, e.g., threads or screws. The discharge member 48 has an upper portion in the form of a cap, and a lower portion serving as the nozzle 35 that has a discharge passage with a small diameter. While, in this embodiment, a lower end of the nozzle 35 provides the discharge opening 33, the present invention is not limited to such an example. For example, a flexible tube may be connected at one end to the nozzle 35, and a nozzle member having a discharge opening may be connected to the other end of the flexible tube. Alternatively, a flexible tube may be connected at one end to the joint portion 59, and the nozzle 35 may be connected to the other end of the flexible tube. The flexible tube can be connected to each of the joint portion 59 and the nozzle 35 through the known connection means (e.g., joint coupling or press-fitting connection). As the length of the flexible tube increases, the responsivity is more significantly improved in this embodiment in comparison with the prior art.

Furthermore, when the discharge member 48 and the nozzle member are connected to each other by the flexible tube, a light-weight head unit can be constituted in which only the nozzle member is mounted to an XYZ driving mechanism.

The pressurization section 60 includes, as in the first embodiment, the reservoir 12, the pressurization passage 62 through which the reservoir and the liquid valve section 50 are communicated with each other, and the pressurization device (not illustrated) for applying pressure to the reservoir.

The negative pressure section 70 includes the shunt passage 72 having the end opening 74. A basic configuration of the negative pressure section 70 is similar to that in the first embodiment, but the negative pressure section 70 in the second embodiment is different from that in the first embodiment in forming the shunt passage 72 as a straight pipe extending in the vertical direction.

In the above-described discharge device 20 of the second embodiment, responsivity in the switching operation of the switching valve is significantly superior to that in the prior-art discharge device utilizing a pressure difference of gas. When a light-weight head unit is constituted by connecting the discharge member 48 and the nozzle member through the flexible tube, an increase of a discharge speed and an improvement of productivity can be expected due to reduction of the weight of the head unit that is relatively moved.

Details of the present invention will be described below in connection with Examples, but the present invention is in no way limited by the following Examples.

Example 1

<Configuration>

Figure 3:
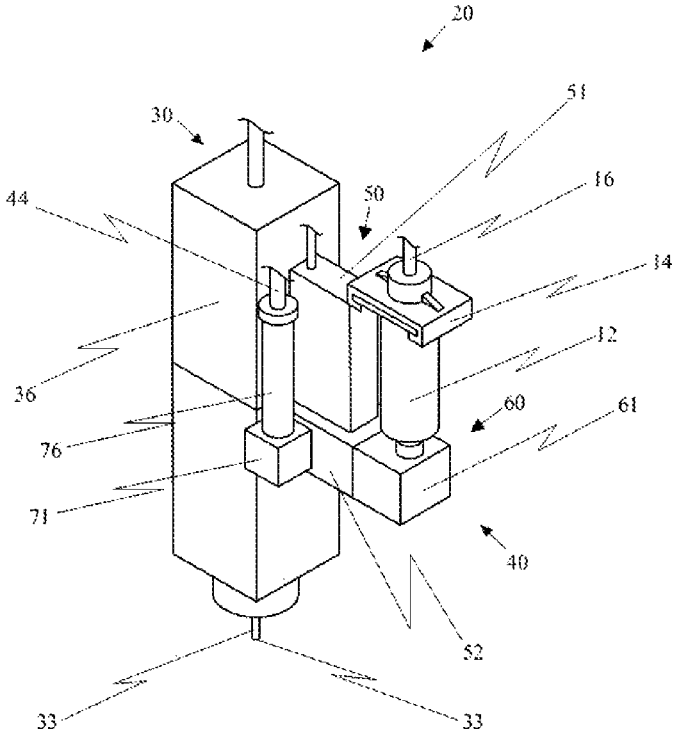
FIG. 3 is a schematic perspective view of a liquid material discharge device according to Example 1.

FIG. 3 is a schematic perspective view of a liquid material discharge device 20 according to Example 1. The discharge device 20 includes a discharge unit 30 that discharges the liquid material, and a liquid delivery unit 40 that supplies and receives the liquid material to and from the discharge unit 30.

Figure 4:
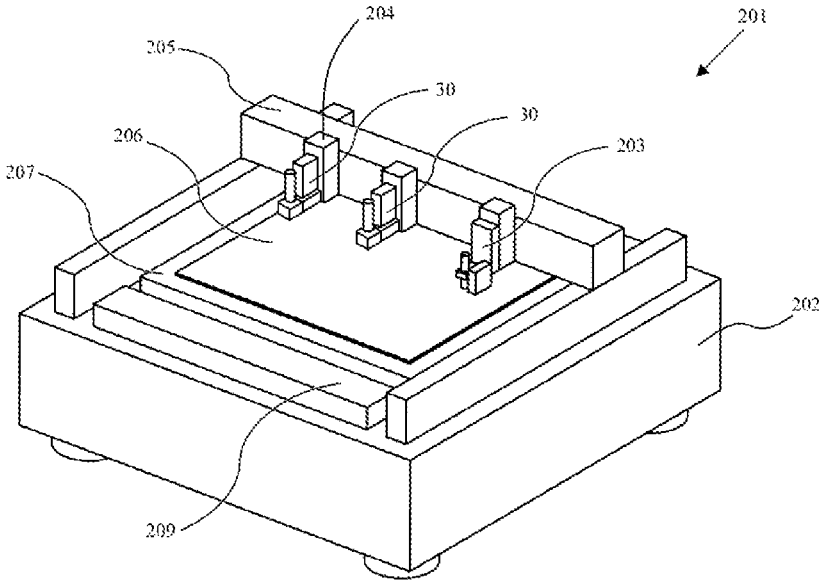
FIG. 4 is a schematic perspective view of an application device to which the liquid material discharge device according to Example 1 is mounted.

FIG. 4 is a schematic perspective view of an application device 201 to which the liquid material discharge device 20 according to Example 1 is mounted. The application device 201 includes a platform 202 on which a table 207 is placed, a relatively-driving unit 205 provided with holders 204, and an adjustment table 208 on which a workpiece for adjustment is placed. The discharge unit 30 or a measurement unit 203 is mounted to each of the holders 204. An application object 206 is placed on the table 207, and an application operation is performed while the discharge unit 30 and the measurement unit 203 are moved relative to the table 207 in the XYZ directions. The relatively-driving unit 205 includes, e.g., a combination of a linear motor magnet and a straight-motion guide, or a combination of a motor and a ball screw, thus moving the discharge unit 30 and the measurement unit 203 relative to the table 207 in the XYZ directions.

Figure 5:
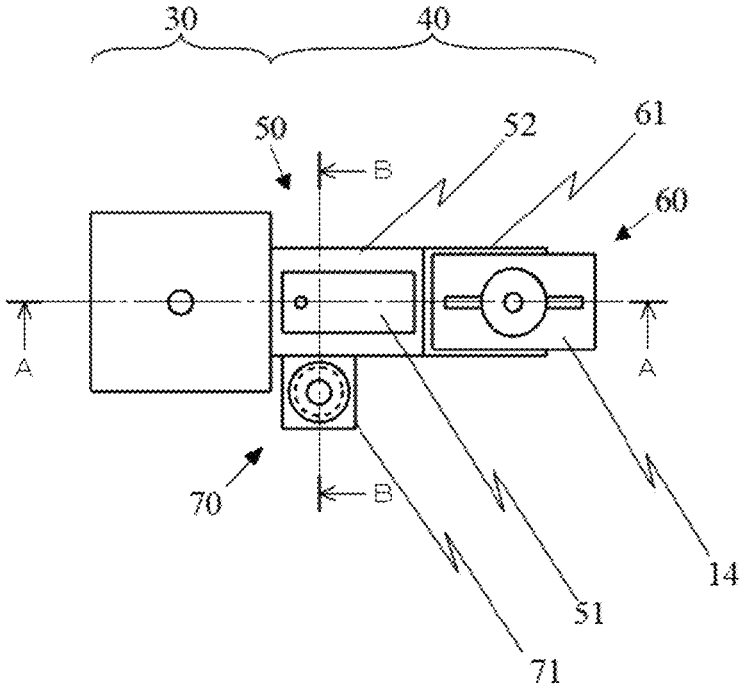
FIG. 5 is a schematic plan view of the liquid material discharge device according to Example 1.
Figure 6:
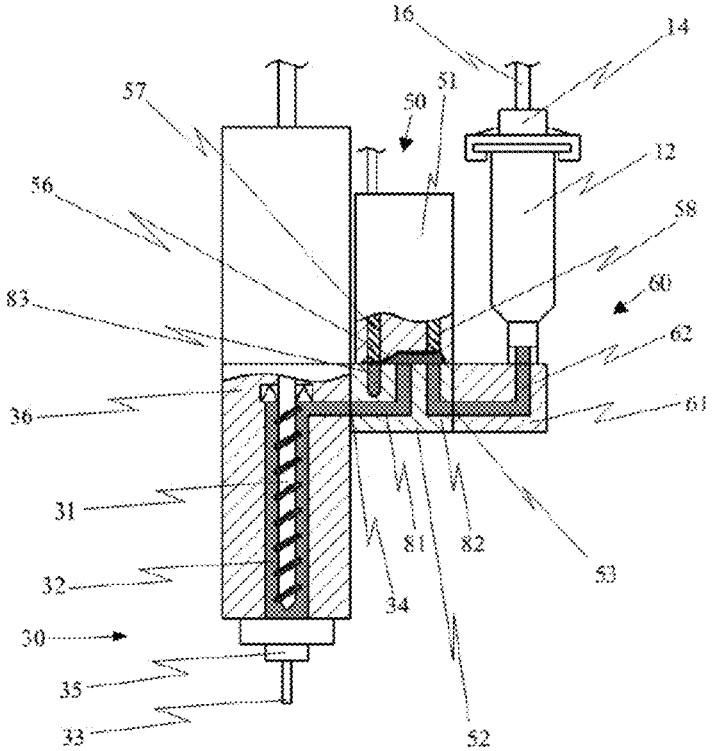
FIG. 6 is a schematic view, partly sectioned, of the liquid material discharge device according to Example 1, the view being referenced to explain a first position of a switching valve.
Figure 7:
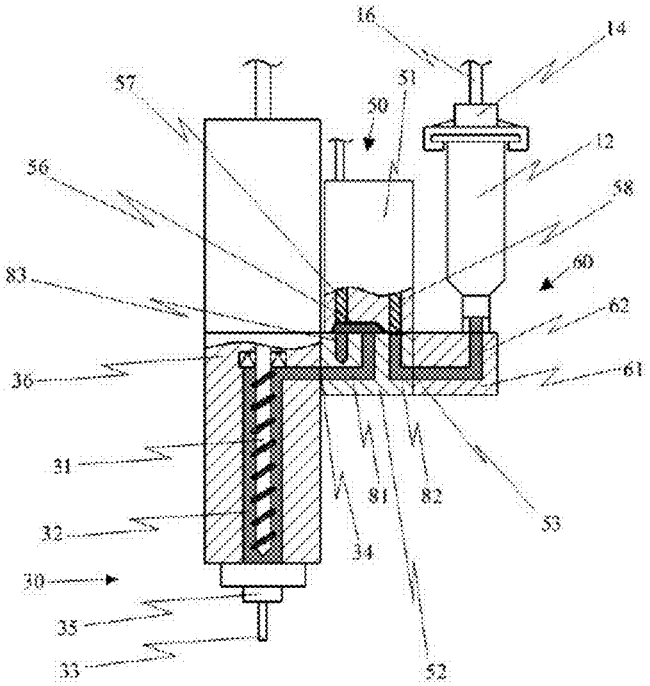
FIG. 7 is a schematic view, partly sectioned, of the liquid material discharge device according to Example 1, the view being referenced to explain a second position of the switching valve.

FIG. 5 is a schematic plan view of the liquid material discharge device 20 according to Example 1. FIGS. 6 and 7 are each a schematic view partly sectioned and taken along A-A in FIG. 5, the view illustrating the passages in the discharge device 20. More specifically, FIG. 6 illustrates a state of the liquid valve section 50 being at a first position at which the liquid chamber 32 and the pressurization passage 62 are communicated with each other. FIG. 7 illustrates a state of the liquid valve section 50 being at a second position at which the liquid chamber 32 and the shunt passage 72 are communicated with each other.

(Discharge Unit)

The discharge unit 30 includes a rod 31 extending in the vertical direction, a discharge unit main body 36 into which the rod 31 is inserted, a liquid chamber 32 that is a space defined within the discharge unit main body 36, a nozzle 35 having an inner passage in communication with the liquid chamber 32, a discharge opening 33 formed at a lower end of the nozzle 35, a liquid material supply opening 34 in communication with a lateral surface of the liquid chamber 32, and a rod driving source 37 (not illustrated) that rotates the rod 31.

The liquid chamber 32 in Example 1 is an elongate cylindrical bore that is formed in the discharge unit main body 36 to extend in the vertical direction. A sealing member allowing fluid-tight insertion of the rod 31 therethrough is fitted in an upper opening of the liquid chamber 32. A lower opening of the liquid chamber 32 is communicated with an inner passage of the nozzle 35 that is removably attached to a tip of the discharge unit main body 36. A lower portion of the rod 31, the lower portion having an inner diameter slightly smaller than that of the liquid chamber 32, is disposed in the liquid chamber 32. A gap between the lower portion of the rod 31 and an inner wall surface of the liquid chamber 32 is preferably set to be larger than the particle diameter of a filler or a filler cluster. The lower portion of the rod 31 includes a spiral groove or blade provided on its surface thereof, and is rotated within the liquid chamber 32 by the not-illustrated rod driving source 37 (e.g., a rotational driving source such as a motor). With the rotation of the rod 31 by the rod driving source 37, a propulsion force is given to the liquid material in the liquid chamber 32, and the liquid material is discharged from the discharge opening 33 that is opened downward.

(Liquid Delivery Unit)

The liquid delivery unit 40 is constituted by a liquid valve section 50, a pressurization section 60, and a negative pressure section 70, which are disposed in an integral structure. The liquid delivery unit 40 is disposed at a lateral surface of the discharge unit 30. More specifically, the pressurization section 60 is disposed adjacent to one lateral surface of the liquid valve section 50, and the negative pressure section 70 is disposed adjacent to another lateral surface of the liquid valve section 50, which is positioned perpendicularly to the one lateral surface of the liquid valve section 50 to which the pressurization section 60 is adjacent.

The liquid valve section 50 is constituted by a switching valve 51 and a valve block 52. The valve block 52 is connected to the lateral surface of the discharge unit 30. More specifically, the valve block 52 is connected to a lateral surface of the discharge unit main body 36, whereby the liquid delivery opening 34 formed in the lateral surface of the discharge unit main body 36 is communicated with a first opening of a passage A 81, the first opening being formed in a lateral surface of the valve block 52.

The switching valve 51 is a diaphragm-type three-way valve that is changed over between a first position at which the discharge unit 30 and the pressurization section 60 (reservoir 12) are communicated with each other, and a second position at which the discharge unit 30 and the negative pressure section 70 (shunt pipe 76) are communicated with each other. The switching valve 51 includes a diaphragm rod A 57 and a diaphragm rod B 58, which are disposed above a diaphragm 56. When the switching valve 51 takes the first position with a descent of the diaphragm rod A 57 and an ascent of the diaphragm rod B58, the diaphragm 56 is deformed to establish the communication between the pressurization section 60 (reservoir 12) and the liquid chamber 32. When the switching valve 51 takes the second position with an ascent of the diaphragm rod A 57 and a descent of the diaphragm rod B 58, the diaphragm 56 is deformed to establish the communication between the negative pressure section 70 (shunt passage 72) and the liquid chamber 32.

The valve block 52 includes a passage A 81, a passage B 82, and a passage C 83 therein. The passage A 81 has a first opening formed in the lateral surface of the valve block 52, and a second opening formed in an upper surface of the valve block 52. The second opening of the passage A 81 is alternatively communicated with the passage B 82 (pressurization passage 62) or the passage C 83 (shunt passage 72) by the switching valve 51.

The passage B 82 has a first opening formed in the upper surface of the valve block 52, and a second opening formed in a lateral surface of the valve block 52. The first opening of the passage B 82 is communicated with the passage A 81 when the switching valve 51 takes the first position, and is cut off from the passage A 81 when the switching valve 51 takes the second position. The second opening of the passage B 82 is communicated with an end opening of the pressurization passage 62, the end opening being formed in a lateral surface of a liquid delivery block A 61.

The pressurization section 60 is constituted by the liquid delivery block A 61, the reservoir 12, and a pressurization device (not illustrated) for supplying, to the reservoir 12, the pressurized air that has been adjusted to the desired pressure.

The liquid delivery block A 61 includes the pressurization passage 62 formed therein. The reservoir 12 is communicated with the passage B 82 through the pressurization passage 62 such that the liquid material 25 under pressurization is supplied to the liquid valve section 50.

The reservoir 12 in which the liquid material is reserved is removably attached to the liquid delivery block A 61. A lower opening of the reservoir 12 is communicated with the pressurization passage 62. An adaptor 14 in communication with a tubing line A 16 in the form of a flexible tube is removably attached to a top of the reservoir 12. The liquid material 25 in the reservoir 12 is in a state pressed toward the liquid delivery block A 61 because the liquid material is subjected to the pressurized air that is adjusted to the desired pressure, and that is supplied through the tube attached to the adaptor 14.

The negative pressure section 70 includes, as main components, a liquid delivery block B 71, a shunt pipe 76, and a negative pressure generator (not illustrated). The negative pressure section 70 is held under a pressure lower than that in the liquid chamber 32 during the discharge operation such that a relatively negative pressure acts on the liquid material in the liquid chamber 32 when the negative pressure section 70 is communicated with the liquid chamber 32.

The liquid delivery block B 71 includes the shunt passage 72 and a drain passage 73 both formed therein. The liquid delivery block B 71 is disposed at a lateral surface of the valve block 52, the lateral surface being positioned perpendicularly to the lateral surface of the valve block 52 to which the discharge unit 30 is connected (see FIG. 3).

Figure 8:
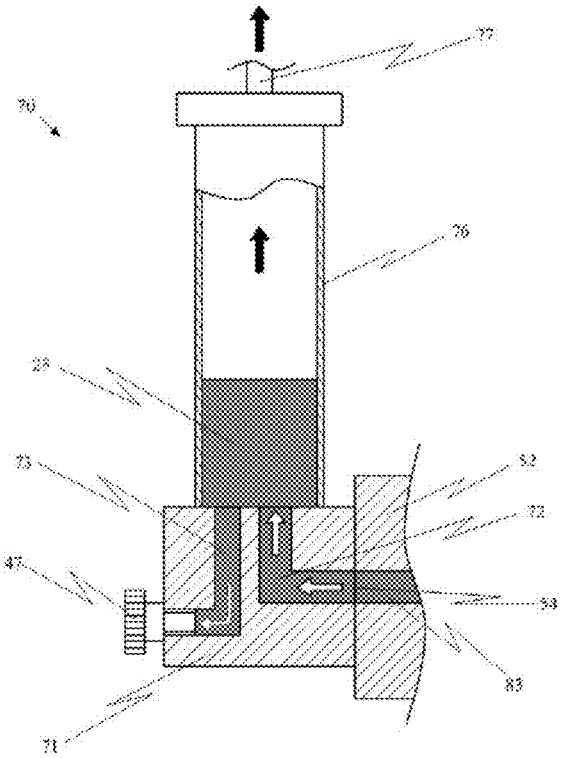
FIG. 8 is a schematic view, partly sectioned, to explain a negative pressure section of the liquid material discharge device according to Example 1.

FIG. 8 is a schematic view, partly sectioned, to explain the negative pressure section 70 of the liquid material discharge device 20 according to Example 1.

The shunt pipe 76 is disposed at a top of the liquid delivery block B 71 to be communicated with inner passages (72, 73) of the liquid delivery block B 71. In other words, a lower end of the shunt pipe 76 is communicated with the shunt passage 72 and the drain passage 73 in the liquid delivery block B 71 (see FIG. 8). The shunt passage 72 is communicated with the liquid material release opening 54 in the valve block 52 and with the passage C 83. A top of the shunt pipe 76 is communicated with one end of a tubing line D 77. The other end of the tubing line D 77 is communicated with the not-illustrated negative pressure generator, such as a vacuum pump, thereby applying the desired negative pressure to the tubing line D 77.

An outer terminal end of the drain passage 73 is watertightly closed by a plug 47 functioning as a drain passage opening/closing mechanism that communicate or cuts off the drain passage 73 with or from the outside. The liquid material stored in the shunt pipe 76 can be drained to the outside by detaching the removable plug 47. The liquid material can be prevented from being sucked into the tubing line D 77 by detaching the plug 47 and draining the liquid material in the shunt pipe 76 periodically.

The tubing line D 77 is preferably provided with a switching valve (see a negative pressure section switching valve 78 described later) for switching over communication with the negative pressure generator (not illustrated) and the pressurization device (not illustrated). The reason is that the liquid material can be quickly drained from the shunt pipe 76 through the steps of lowering the pressure supplied to the adaptor 14 down to the atmosphere pressure, changing over the switching valve 51 to the first position, detaching the plug 47, and supplying a pressing force from the pressurization device through the tubing line D 77. Such a configuration is particularly effective in draining a highly-viscous liquid material that is rather hard to flow out with an operation of simply detaching the plug 47.

In Example 1, the liquid delivery unit 40 is constituted in a compact structure because the shunt pipe 76 having a long size, the switching valve 51 having a rectangular parallelepiped shape, and the reservoir 12 having a long size are all arranged to extend in the vertical direction.

<Operation>

The operation of the liquid material discharge device 20 according to Example 1 will be described below with reference to FIGS. 6 and 7.

(Discharge State)

For preparation, a system line until reaching the discharge opening 33 from the reservoir 12 through the pressurization passage 62, the liquid valve section 50 (i.e., the passage A 81 and the passage B 82), and the liquid chamber 32 is filled with the liquid material 25 supplied from the reservoir 12. The desired pressure is applied to the reservoir 12 from the pressurization device (not illustrated) through the adaptor 14.

The liquid material 25 in the liquid chamber 32 is discharged through the discharge opening 33 by setting the switching valve 51 to the first position at which the pressurization passage 62 and the liquid chamber 32 are communicated with each other (FIG. 6), and by rotating the rod 31. At that time, an amount of the discharged liquid material is adjusted by controlling the rotation speed and time of the rod 31, and/or the air pressure applied to the reservoir 12.

(Discharge End State A)

The rotation of the rod 31 is stopped, and the switching valve 51 is set to the second position at which the shunt passage 72 and the liquid chamber 32 are communicated with each other. Upon the switching valve 51 being set to the second position (FIG. 7), the pressure remaining in the liquid chamber 32 and the passage A 81 is released toward the shunt passage 72 that is adjusted to be kept under negative pressure, whereby the discharge of the liquid material through the discharge opening is ended promptly. Furthermore, pressures in the liquid chamber 32 and the passage A 81 are also set to a relatively low level equal to that in the shunt passage 72 and the shunt pipe 76. Accordingly, the liquid material 25 can be prevented from dripping through the discharge opening 33 by gravity due to the weight thereof.

At that time, since the communication between the reservoir 12 and the liquid chamber 32 is cut off, the pressure can be continuously applied to the reservoir 12 with no need of depressurization.

(Discharge End State B: Two-Step Adjustment)

A mode for setting the negative pressure, which is applied to the shunt passage 72 immediately after the end of the discharge, to a higher level and setting the negative pressure, which is applied to the shunt passage 72 in the discharge stand-by state, to a lower level will be described below.

In order to rapidly release the pressure remaining in the liquid chamber 32 immediately after the end of the discharge, a stronger negative pressure than that in the discharge stand-by state is applied to the shunt passage 72 during the discharge operation by the negative pressure generator (not illustrated). When, in such a state, the rotation of the rod 31 is stopped and the switching valve 51 is set to the second position, the pressure remaining in the liquid chamber 32 and the passage A 81 is rapidly released toward the shunt passage 72 by the action of the strong negative pressure, and the discharge of the liquid material through the discharge opening is rapidly ended. After the pressure remaining in the liquid chamber 32 and the passage A 81 has been released, a weaker negative pressure than that during the discharge operation (i.e., a negative pressure required to prevent the liquid dripping through the discharge opening 33) is applied to the shunt passage 72 by the negative pressure generator (not illustrated) in communication with the shunt passage 72. As a result, the liquid material 25 can be prevented from dripping through the discharge opening 33 by gravity due to the weight thereof.

According to the above-described discharge device 20 of Example 1, the liquid material 25 in the liquid chamber 32 can be pressurized or depressurized by changing over the flow of the liquid material with the switching valve 51. Since the pressurization and the depressurization in the liquid chamber 32 are performed with the aid of the liquid material that is not compressive, responsivity is very high. Moreover, in the discharge stand-by state, the liquid dripping through the discharge opening can be prevented.

Example 2

Figure 9:
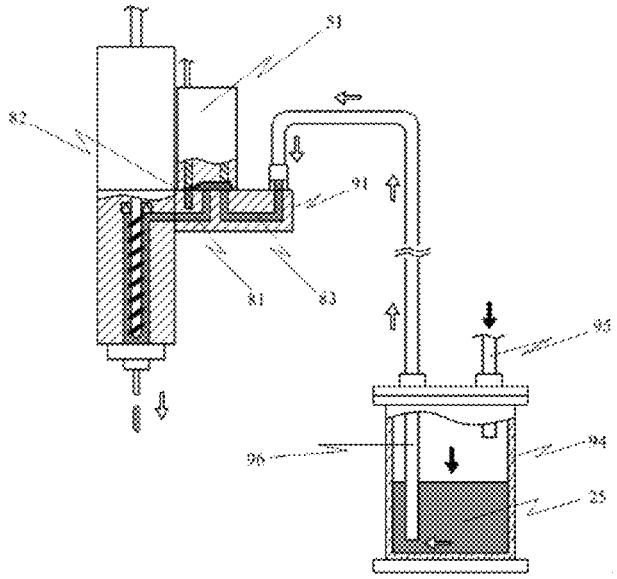
FIG. 9 is an explanatory view to explain a liquid material discharge device according to Example 2.

FIG. 9 is a schematic side view, partly sectioned, to explain a liquid material discharge device according to Example 2. In the following, description of components common to those in Example 1 is omitted, and components different therefrom are primarily described.

A discharge unit 30 in Example 2 has the same structure as that in Example 1.

The liquid valve section 50 and the pressurization section 60 are different from those in Example 1 in including a liquid delivery block C 91 and a tank 94.

The liquid delivery block C 91 is a member constituted by integrating the valve block 52 and the liquid delivery block A 61 in Example 1 into one unit. Accordingly, the switching valve 51 and the liquid delivery block B 71 are connected to the liquid delivery block C 91. The liquid delivery block C 91 includes a passage A 81, a passage B 82, and a passage C 83 therein. The passage B 82 functions as a shunt passage, and the passage C 83 functions as a pressurization passage.

The passage C 83 is communicated with the tank 94 through a tubing line F 96 in the form of a flexible tube.

The tank 94 is a large-sized container in which the liquid material 25 is stored. Pressurized air having been adjusted to the desired pressure is applied to the liquid material 25, which is stored in the tank 94, through a tubing line E 95. The liquid material 25 pressed by the pressurized air is supplied to the passage C 83 in the liquid delivery block C 91 through the tubing line F 96. In Example 2, as in Example 1, the pressure applied to the tank 94 through the tubing line E 95 is just required to be kept constant without being reduced per discharge.

Figure 10:
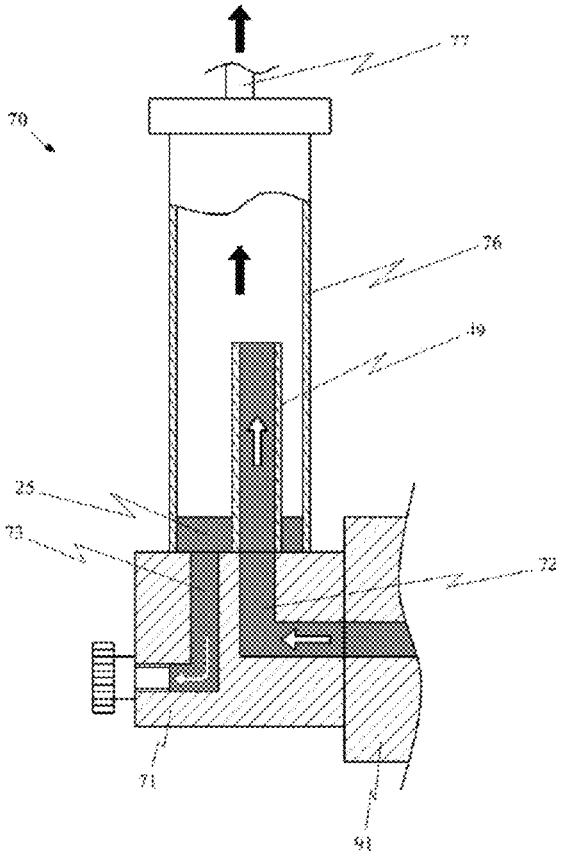
FIG. 10 is a schematic view, partly sectioned, to explain a negative pressure section of the liquid material discharge device according to Example 2.

FIG. 10 is a schematic view, partly sectioned, to explain a negative pressure section 70 of the liquid material discharge device according to Example 2.

A shunt pipe 76 in Example 2 includes a slender negative pressure adjusting pipe 49 that extends within the shunt pipe 76 in the vertical direction. One end opening of the negative pressure adjusting pipe 49 having a smaller diameter than the shunt pipe 76 is communicated with the shunt passage 72, and the other end opening thereof is positioned in a space within the shunt pipe 76. In Example 2, since the height of a liquid surface can be kept constant with the provision of the negative pressure adjusting pipe 49, the negative pressure supplied to the shunt pipe 76 can be held at a certain level or below regardless of the amount of the liquid material withdrawn to the shunt pipe 76. On the other hand, in the shunt pipe 76 (see FIG. 8) not including the negative pressure adjusting pipe 49, the negative pressure supplied through the tubing line D 77 needs to be intensified as the amount of the liquid material stored in the shunt pipe 76 increases.

With the provision of the negative pressure adjusting pipe 49, since the sucked liquid material 25 is stored in the shunt pipe 76 after falling from a terminal end of the negative pressure adjusting pipe 49, it is just enough to supply, through the tubing line D 77, negative pressure that is required to generate the negative pressure acting on the liquid material in the negative pressure adjusting pipe 49. In other words, there is no necessity of adjusting the negative pressure, which is to be caused to act on the shunt passage 72 to prevent the liquid dripping, depending on the amount of the liquid material stored in the shunt pipe 76. If the water head position of the liquid material stored in the shunt pipe 76 reaches the height of the terminal end of the negative pressure adjusting pipe 49, the effect of the negative pressure adjusting pipe 49 is no longer obtained. Thus, before reaching such a state, the liquid material in the shunt pipe 76 is drained through the drain passage 73.

The length of the negative pressure adjusting pipe 49 is set to, for example, ⅓ or more and preferably ½ or more of the length of the shunt pipe 76. The negative pressure adjusting pipe 49 in Example 2 has the same diameter as the shunt passage 72.

Preferably, the discharge operation is performed after filling the liquid material in the shunt pipe 76 up to the same height as the terminal end of the negative pressure adjusting pipe 49. The reason is that the pressure at the discharge opening 33 can be held constant by specifying a lower end position (tip of the discharge opening 33) and an upper end position (terminal end of the negative pressure adjusting pipe 49) in the passage filled with the liquid material to be constant.

The discharge device of Example 2 can realize, in addition to high responsivity as in Example 1, another advantageous effect of simplifying the pressure adjustment needed to prevent the liquid dripping. It is to be noted that the negative pressure adjusting pipe 49 in Example 2 can be applied to other Examples as well.

Example 3

Figure 11:
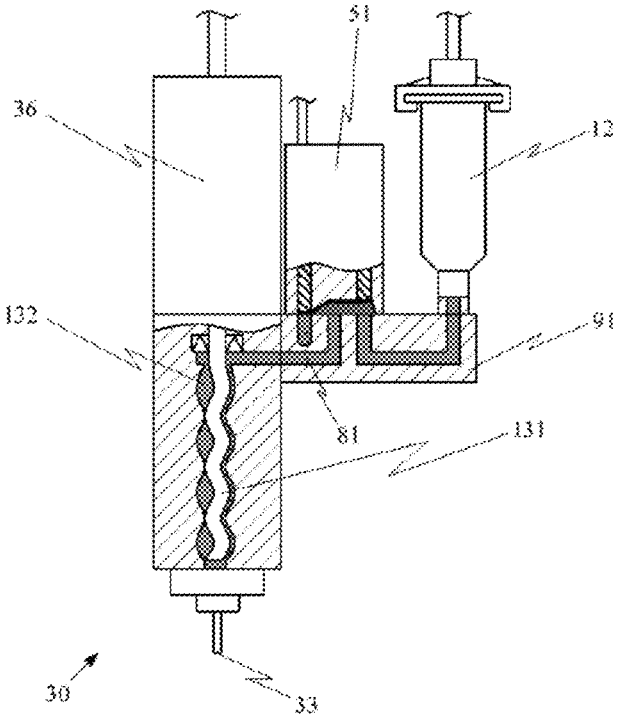
FIG. 11 is a side view, partly sectioned, to explain a liquid material discharge device according to Example 3.

FIG. 11 is a side view, partly sectioned, to explain a liquid material discharge device 20 according to Example 3. In the following, description of components common to those of Example 2 is omitted, and components different therefrom are primarily described.

A liquid delivery unit (including a liquid valve section 50, a pressurization section 60, and a negative pressure section 70) in Example 3 has the same configuration as that in Example 2. A discharge unit 30 in Example 3 is different from that in Example 2 in shapes of the propulsion force applying member (rod) and the liquid chamber.

The discharge device 20 of Example 3 includes a uniaxial eccentric screw pump mechanism of rotary displacement type, and it is employed to discharge a highly-viscous fluid or a fluid mixed with a solid matter containing powder or particles. In the uniaxial eccentric screw pump mechanism, a male screw rotor 131 is fitted into a female screw stator bore 132. Stated from another point of view, the male screw rotor 131 serves as the propulsion force applying member, and the female screw stator bore 132 serves as the liquid chamber in communication with the discharge opening 33.

For example, the male screw rotor 131 is formed in the shape of a single male thread with a longitudinal section being substantially true-circular, and the pitch of the spiral shape is set to ½ of that of the stator bore 132. When the rotor 131 is rotated in a predetermined direction, the liquid material present in a space between the rotor 131 and the stator bore 132 is transferred and discharged through the discharge opening 33. At that time, the rotor 131 performs eccentric rotational motion in such a manner that it rotates about its axis while revolving about a center axis of the stator bore 132. An upper end of the rotor 131 is connected to a rotor driving mechanism (not illustrated) that eccentrically rotates the rotor 131.

The discharge device 20 of Example 3 accompanies with the problem of the liquid dripping because the communication between the stator bore 132 and the discharge opening 33 is not cut off in the discharge stand-by state. It is therefore required to quickly release the pressure remaining in the stator bore 132, and to apply the negative pressure to the stator bore 132 in the discharge stand-by state.

In this regard, since the discharge device 20 of Example 3 includes the liquid delivery unit similar to that in Example 2, the pressure remaining in the stator bore 132 can be quickly released and the problem of the liquid dripping can be overcome by communicating the stator bore 132 and the negative pressure section 70 with each other through the switching valve 51 at the end of the discharge. Furthermore, it is also possible to realize the mode of setting relatively higher the negative pressure that is to be applied to the shunt passage immediately after the end of the discharge, and of setting relatively lower the negative pressure that is to be applied to the shunt passage in the discharge stand-by state.

According to the above-described discharge device 20 of Example 3, since pressurization and depressurization in the stator bore 132 are performed with the aid of the liquid material that is not compressive, responsivity is very high. Moreover, since the discharge device 20 of Example 3 includes the same liquid delivery unit as that in Example 2, the pressure adjustment necessary to prevent the liquid dripping is simplified.

Example 4

Figure 12:
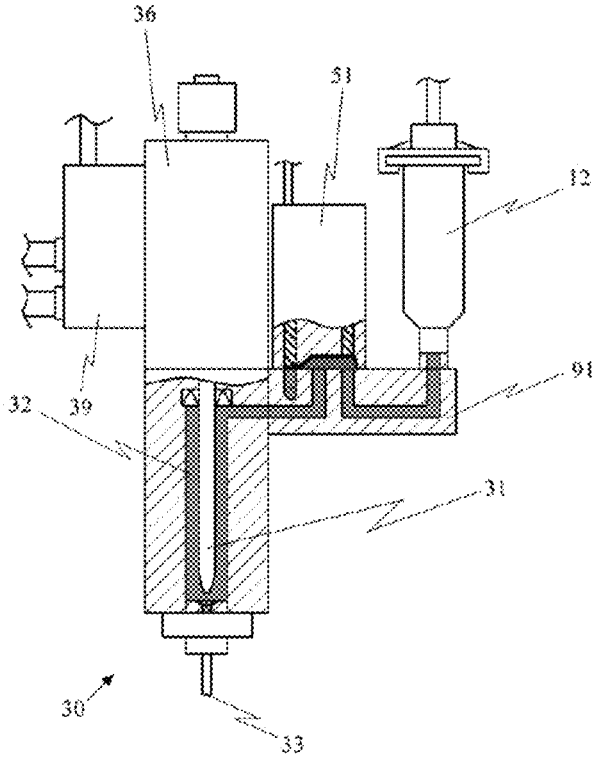
FIG. 12 is a side view, partly sectioned, to explain a liquid material discharge device according to Example 4.

FIG. 12 is a schematic side view, partly sectioned, to explain a liquid material discharge device 20 according to Example 4. In the following, description of components common to those in Examples 2 and 3 is omitted, and components different therefrom are primarily described.

A liquid delivery unit (including a liquid valve section 50, a pressurization section 60, and a negative pressure section 70) in Example 4 has the same configuration as those in Examples 2 and 3.

A discharge unit 30 in Example 4 is a known jet-type discharge device in which a rod 31 is reciprocated at a high speed and a liquid material is discharged in a way of flying in the form of droplets from a discharge opening 33 with forward movement of the rod 31. In that type of discharge unit 30, because a tip of the rod 31 is not seated against a bottom surface of a liquid chamber 32 in the discharge stand-by state, the discharge opening 33 and the liquid chamber 32 are kept in the communicated state even in the discharge stand-by state. Accordingly, there is a possibility that the liquid dripping may occur in the discharge stand-by state. However, the occurrence of the liquid dripping is prevented by the liquid delivery unit having the same configuration as those in Examples 2 and 3. The discharge unit may be of the type that, in the discharge turn-on state, the tip of the rod 31 is seated against the bottom surface of the liquid chamber 32, or the tip of the rod 31 is not seated against the bottom surface of the liquid chamber 32.

A piston chamber, not illustrated, is disposed in an upper portion of a discharge unit main body 36, and a piston disposed above the rod 31 is operated to slide in the piston chamber. The piston chamber is communicated with a switching valve 39 such that pressurized air is supplied to the piston chamber through the switching valve 39, and that the air in the piston chamber is released through the switching valve 39. The rod 31 is thereby reciprocated.

The discharge device of Example 4, which includes the liquid delivery unit having the same configuration as those in Examples 2 and 3, can realize, in addition to high responsivity, another advantageous effect of simplifying the pressure adjustment needed to prevent the liquid dripping.

Example 5

<Configuration>

Figure 13:
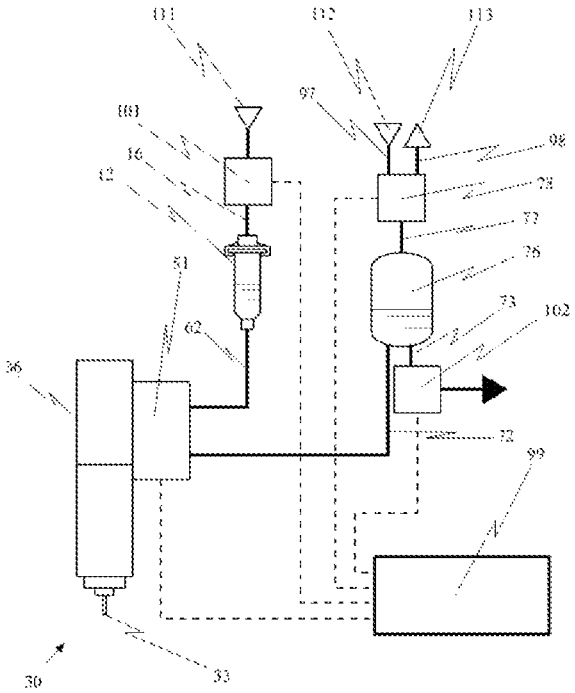
FIG. 13 is a schematic view illustrating an overall configuration of a liquid material discharge device according to Example 5.

FIG. 13 is a schematic view illustrating an overall configuration of a liquid material discharge device 20 according to Example 5.

A discharge unit 30 is a known jet-type discharge device or a known screw-type discharge device. A discharge unit main body 36 includes a liquid chamber 32 in fluid communication with the discharge opening 33 and with inner passages of a switching valve 51. The switching valve 51 is disposed at a lateral surface of the discharge unit main body 36 to be optionally connected to the liquid chamber 32, the pressurization passage 62, and the shunt passage 72 for fluid communication therewith.

As illustrated in FIG. 13, a pressurization-section on/off valve 101 is disposed upstream of a reservoir 12, a drain-passage on/off valve 102 is disposed in a drain passage 73 in communication with a shunt tube 76, and a negative pressure section switching valve 78 for switching over gas passages is disposed upstream of the shunt pipe 76. The switching valve 51 for switching over liquid passages has a first position at which the reservoir 12 and the liquid chamber 32 are communicated with each other, and a second position at which the shunt pipe 76 and the liquid chamber 32 are communicated with each other. The pressurization-section on/off valve 101, the drain-passage on/off valve 102, the switching valve 51, and the negative pressure section switching valve 78 are operated to be selectively opened and closed in accordance with commands from a controller 99.

The pressurization-section on/off valve 101 may be disposed between the reservoir 12 and the switching valve 51 instead of being disposed upstream of the reservoir 12. In other words, the pressurization-section on/off valve 101 may be disposed in the pressurization passage 62 to establish or cut off the communication between the reservoir 12 and the switching valve 51.

The pressurization-section on/off valve 101 is disposed in a tubing line A 16 through which air having been adjusted to the desired pressure is supplied to the reservoir 12, and it establishes or cuts off the communication between an air supply source 111 and the reservoir 12. In other words, the pressurization-section on/off valve 101 has an opened position at which the air supply source 111 and the reservoir 12 are communicated with each other, and a closed position at which the communication between them is cut off.

The drain-passage on/off valve 102 is disposed in the drain passage 73, and it functions as the drain-passage opening/closing mechanism that establishes or cuts off the communication between the shunt pipe 76 and the outside. Thus, the drain-passage on/off valve 102 has an opened position at which the drain passage 73 is communicated with the outside, and a closed position at which the communication between the drain passage 73 and the outside is cut off.

The negative pressure section switching valve 78 is connected to a tubing line G 97 in communication with a pressurization source 112 and to a tubing line H 98 in communication with a negative pressure source 113, and it alternatively switches over the communication of a tubing line D 77 (and the shunt pipe 76) with the tubing line G 97 or H 98. In other words, the negative pressure section switching valve 78 has a pressurization position at which the tubing line G 97 and the shunt pipe 76 are communicated with each other, and a depressurization position at which the tubing line H 98 and the shunt pipe 76 are communicated with each other.

Each of the air supply source 111 and the pressurization source 112 supplies the pressurized air having been adjusted to the desired pressure, and the negative pressure source 113 causes an air suction pressure to act in the tubing line H 98 such that the desired negative pressure is obtained in the tubing line H 98.

<Discharge Operation>

(Discharge State)

The discharge operation is started from a state where the liquid material 25 supplied from the reservoir 12 is fully filled in a system line from the reservoir 12 to the discharge opening 33 through the pressurization passage 62, the switching valve 51, and the liquid chamber 32.

The controller 99 sets the pressurization-section on/off valve 101 to the opened position and simultaneously sets the switching valve 51 to the first position at which the pressurization passage 62 and the liquid chamber 32 are communicated with each other. Almost at the same time as the above settings, the controller 99 operates the rod 31, whereby the liquid material in the liquid chamber 32 is discharged through the discharge opening 33.

(At End of Discharge)

The controller 99 stops the operation of the rod 31, sets the switching valve 51 to the second position at which the shunt passage 72 and the liquid chamber 32 are communicated with each other, and sets the negative pressure section switching valve 78 to the depressurization position. As a result, the pressure remaining in the liquid chamber 32 is released toward the shunt passage 72 that is adjusted to be kept under the negative pressure, and the discharge of the liquid material through the discharge opening is quickly ended.

<Liquid Material Drain Operation>

An operation of draining the liquid material, which is stored in the shunt pipe 76, to the outside will be described below.

The controller 99 closes the pressurization-section on/off valve 101, and sets the switching valve 51 to the first position at which the reservoir 12 and the liquid chamber 32 are communicated with each other. As a result, the communication between the reservoir 12 and the liquid chamber 32 is established, but the pressurization-section on/off valve 101 is closed. Therefore, the liquid material in the reservoir 12 is not pressurized, and a possibility of leakage of the liquid material through the discharge opening 33 is minimal. Furthermore, when the switching valve 51 is held at the first position, the communication between the shunt pipe 76 and the liquid chamber 32 is cut off by the switching valve 51.

The controller 99 sets the negative pressure section switching valve 78 to the pressurization position at which the tubing line G 97 and the tubing line D 77 are communicated with each other. As a result, the interior of the shunt pipe 76 is changed from a negative pressure atmosphere to a pressurization atmosphere.

Subsequently, the controller 99 changes over the drain-passage on/off valve 102 to the opened position. As a result, the liquid material in the shunt pipe 76 is drained to the outside through the drain-passage on/off valve 102. It is to be noted that, when the switching valve 51 is held at the first position, the communication between the shunt passage 72 and the liquid chamber 32 is cut off, and the liquid material in the shunt pipe 76 is prevented from flowing into the liquid chamber 32 through the shunt passage 72.

According to the above-described liquid material discharge device of Example 5, since the opening/closing and the changing-over of each valve can be automatically performed in accordance with the commands from the controller 99, periodic discarding of the liquid material in the shunt pipe 76 can be automated.

INDUSTRIAL APPLICABILITY

The present invention is applicable to liquid material discharge devices of various discharge types.

As examples of the discharge device of the discharge type that the liquid material comes into touch with a workpiece before leaving the discharge unit, the following types are disclosed here, namely a tubing type including a flat tubing mechanism or a rotary tubing mechanism, a plunger type discharging the liquid material by moving, through the desired stroke, a plunger that slides in close contact with an inner surface of a reservoir including a nozzle at its tip, a screw type discharging the liquid material with rotation of a screw, and a valve type controlling discharge of the liquid material, to which the desired pressure is applied, with opening/closing of a valve.

As examples of the discharge device of the discharge type that the liquid material comes into touch with a workpiece after leaving the discharge unit, the following types are disclosed here, namely a jet type striking a valve member against a valve seat, thus causing the liquid material to fly from a nozzle tip, a plunger jet type moving a plunger or a plunger type member, and abruptly stopping the plunger, thus causing the liquid material to fly from a nozzle tip as in the above jet type, and an ink jet type operating in a continuous ejection mode or a demand mode.

REFERENCE SIGNS LIST

1: main body, 2: screw through-hole, 3: passage, 4: inlet, 5: housing, 6: nozzle, 7: screw, 8: rod, 9: motor, 10: liquid material discharge device, 11: attachment opening, 12: reservoir, 13: controller, 14: adaptor, 15: sealing member, 16: tubing line A, 17: tubing line B, 18: tubing line C, 20: liquid material discharge device, 25: liquid material, 30: discharge unit, 31: rod, 32: liquid chamber, 33: discharge opening, 34: liquid delivery opening, 35: nozzle, 36: discharge unit main body, 37: rod driving source, 38: opening in bottom surface of liquid chamber, 39: switching valve, 40: liquid delivery unit, 45: release opening, 47: plug, 48: discharge member, 49: negative pressure adjusting pipe, 50: liquid valve section, 51: switching valve, 52: valve block, 53: liquid material supply opening, 54: liquid material release opening, 55: valve member, 56: diaphragm, 57: diaphragm rod A, 58: diaphragm rod B, 59: joint portion, 60: pressurization section, 61: liquid delivery block A, 62: pressurization passage, 70: negative pressure section, 71: liquid delivery block B, 72: shunt passage, 73: drain passage, 74: end opening, 76: shunt pipe, 77: tubing line D, 78: switching valve, 81: passage A, 82: passage B, 83: passage C, 84: switching passage, 91: liquid delivery block C, 94: tank, 95: tubing line E, 96: tubing line F, 97: tubing line G, 98: tubing line H, 99: controller, 101: pressurization-section on/off valve, 102: drain-passage on/off valve, 111: air supply source, 112: pressurization source, 113: negative pressure source, 131: rotor, 132: stator bore, 151: switching valve, 155: valve member, 201: application device, 202: platform, 203: measurement unit, 204: holder, 205: relatively-driving unit, 206: application object, 207: table, 209: adjustment table

The invention claimed is:

1. A liquid material discharge device comprising:

a nozzle member having a discharge opening through which a liquid material is discharged;

a discharge controller;

a pressurization section including a pressurization passage through which the liquid material under pressurization is supplied to the nozzle member, a liquid reservoir, and a pressurization source that supplies pressurized air to the liquid reservoir;

a negative pressure section including a shunt passage in which a pressure is set to be lower than a pressure in the pressurization passage and a negative pressure source that is directly or indirectly communicated with the shunt passage; and a liquid valve section having a liquid delivery opening in communication with the discharge opening, a liquid material supply opening in communication with the pressurization passage, and a liquid material release opening in communication with the shunt passage; and the liquid valve section including a switching valve that is changed over between a first position and a second position, the first position establishing communication between the discharge opening and the liquid material supply opening and cutting off communication between the discharge opening and the liquid material release opening the second position establishing the communication between the discharge opening and the liquid material release opening and cutting off the communication between the discharge opening and the liquid material supply opening, wherein the liquid material is held in the shunt passage in the first position and the second position.

2. The liquid material discharge device according to claim 1, wherein the discharge device further comprises a liquid chamber in communication with the discharge opening and with the liquid delivery opening of the liquid valve section;

a propulsion force applying member disposed in the liquid chamber and applying, to the liquid material, a propulsion force necessary to discharge the liquid material; and a driving source for the propulsion force applying member, the driving source operating the propulsion force applying member.

3. The liquid material discharge device according to claim 2, wherein the propulsion force applying member is a rotating screw or a rod-shaped member that gives an inertial force to the liquid material with quick forward movement, the screw and the rod-shaped member each having a smaller diameter than the liquid chamber.

4. The liquid material discharge device according to claim 2, wherein the propulsion force applying member is a rod having a male spiral shape and rotating eccentrically, the liquid chamber has an inner wall surface having a female spiral shape and cooperating with the propulsion force applying member, and the propulsion force applying member and the liquid chamber constitute a uniaxial eccentric screw pump mechanism.

5. The liquid material discharge device according to claim 1, wherein the liquid valve section and the nozzle member are communicated with each other through a flexible tube.

6. The liquid material discharge device according to claim 1, wherein the negative pressure section includes a shunt container for the liquid material, the shunt container having a larger diameter than the shunt passage.

7. The liquid material discharge device according to claim 6, wherein the negative pressure section includes a drain passage through which the liquid material stored in the shunt container is drained.

8. The liquid material discharge device according to claim 7, wherein the negative pressure section includes a drain passage opening/closing mechanism that establishes or cuts off communication between the drain passage and the outside.

9. The liquid material discharge device according to claim 8, wherein the negative pressure section includes a second pressurization source that supplies pressurized air to the shunt container, and a negative pressure section switching valve having a pressurization position at which the second pressurization source is communicated with the shunt container, and a depressurization position at which the negative pressure source is communicated with the shunt container.

10. The liquid material discharge device according to claim 9, wherein the drain passage opening/closing mechanism is an on/off valve, the pressurization section includes a pressurization-section on/off valve that establishes or cuts off communication between the pressurization section and the liquid valve section, and the discharge controller closes the pressurization-section on/off valve, changes over the switching valve in the liquid valve section to the first position, changes over the negative pressure section switching valve to the pressurization position, and opens the drain passage opening/closing mechanism in accordance with predetermined drain conditions, thereby draining the liquid material in the shunt container to the outside.

11. The liquid material discharge device according to claim 6, wherein the negative pressure section includes a slender negative pressure adjusting pipe disposed in the shunt container, the negative pressure adjusting pipe having one opening in communication with the shunt passage and the other opening disposed in a space within the shunt container.

12. The liquid material discharge device according to claim 1, wherein the discharge controller performs control such that, in a discharge stand-by state, a negative pressure force necessary to prevent liquid dripping through the discharge opening is applied to the shunt passage from the negative pressure source, and that, at end of the discharge, a negative pressure force stronger than the negative pressure force applied in the discharge stand-by state is applied to the shunt passage from the negative pressure source.

13. The liquid material discharge device according to claim 1, wherein the discharge controller performs control such that, during discharge operation, a pressurization force necessary to discharge the liquid material through the discharge opening is applied to the liquid reservoir from the pressurization source, and that, in a discharge stand-by state, a pressurization force stronger than the pressurization force during the discharge operation is applied to the liquid reservoir from the pressurization source.

14. An application device comprising:

the liquid material discharge device according to claim 1;

a work table on which an application object is placed;

an XYZ driving mechanism that relatively moves the liquid material discharge device and the work table; and a driving mechanism controller that controls operation of the XYZ driving mechanism.

15. A liquid material application method using an application device that comprises the liquid material discharge device according to claim 1, a work table on which an application object is placed, a driving mechanism that relatively moves the liquid material discharge device and the work table, and a driving mechanism controller that controls operation of the driving mechanism, wherein the discharge controller executes steps of, during discharge operation, discharging the liquid material through the discharge opening in a state that the switching valve in the liquid valve section is held at the first position, and at end of the discharge, stopping the discharge of the liquid material through the discharge opening by changing over the switching valve in the liquid valve section to the second position.

16. A liquid material application method using an application device that comprises the liquid material discharge device according to claim 1, a work table on which an application object is placed, a driving mechanism that relatively moves the liquid material discharge device and the work table, and a driving mechanism controller that controls operation of the driving mechanism, wherein the discharge controller executes steps of, during discharge operation, discharging the liquid material through the discharge opening in a state that the switching valve in the liquid valve section is held at the first position, and at end of the discharge, stopping the discharge of the liquid material through the discharge opening by changing over the switching valve in the liquid valve section to the second position, the discharge controller further executing steps of, in a discharge stand-by state, applying a negative pressure force, which is necessary to prevent liquid dripping through the discharge opening, to the shunt passage from the negative pressure source, and at the end of the discharge, applying a negative pressure force, which is stronger than the negative pressure force in the discharge stand-by state, to the shunt passage from the negative pressure source.

17. The liquid material application method according to claim 16, wherein the discharge controller executes steps of, during the discharge operation, applying a pressurization force, which is necessary to discharge the liquid material through the discharge opening, to the liquid reservoir from the pressurization source, and in the discharge stand-by state, applying a pressurization force, which is stronger than the pressurization force during the discharge operation, to the liquid reservoir from the pressurization source.

18. A liquid material application method using an application device that comprises the liquid material discharge device according to claim 10, a work table on which an application object is placed, a driving mechanism that relatively moves the liquid material discharge device and the work table, and a driving mechanism controller that controls operation of the driving mechanism, wherein the discharge controller executes steps of, during discharge operation, discharging the liquid material through the discharge opening in a state that the switching valve in the liquid valve section is held at the first position, and at end of the discharge, stopping the discharge of the liquid material through the discharge opening by changing over the switching valve in the liquid valve section to the second position, the discharge controller further executing a step of draining the liquid material in the shunt container to the outside by closing the pressurization section on/off valve, changing over the switching valve in the liquid valve section to the first position, changing over the negative pressure section switching valve to the pressurization position, and opening the on/off valve of the drain passage opening/closing mechanism in accordance with predetermined drain conditions.

19. The liquid material discharge device according to claim 1, wherein the liquid material is held in the nozzle member and the shunt passage both in the first position and the second position.

* * * * *